US005571033A

United States Patent [19]

Kinsey, Jr. et al.

[11] Patent Number: 5,571,033

[45] Date of Patent: Nov. 5, 1996

[54] ELECTRICAL CONNECTOR HAVING PRESS-FIT CONTACTS FOR CIRCUIT BOARD MOUNTING

[75] Inventors: Forrest I. Kinsey, Jr., Harrisburg; Clifford J. Wampler, Lebanon, both of Pa.

[73] Assignee: The Whitaker Corporation, Wilmington, Del.

[21] Appl. No.: 395,394

[22] Filed: Feb. 21, 1995

[51] Int. Cl.[6] ..... H01R 13/422

[52] U.S. Cl. ..... 439/595; 439/444; 439/876

[58] Field of Search ..... 439/444, 595, 439/733.1, 869, 871, 83, 876

[56] References Cited

U.S. PATENT DOCUMENTS

| | | | |
|---|---|---|---|
| 3,095,470 | 6/1963 | Dozier | 439/733.1 |
| 3,101,229 | 8/1963 | Yopp | 439/598 |
| 3,254,323 | 5/1966 | Wyse | 339/105 |
| 3,255,427 | 6/1966 | Yeiser | 339/59 |
| 3,545,606 | 12/1970 | Bennett et al. | 206/56 |
| 3,761,871 | 9/1973 | Teurlings | 339/221 R |
| 3,866,998 | 2/1975 | Iantorno | 339/220 R |
| 3,897,131 | 7/1975 | Stauffer | 339/220 R |
| 4,035,047 | 7/1977 | Ammon | 339/17 C |
| 4,110,904 | 9/1978 | Johnson | 29/628 |
| 4,186,982 | 2/1980 | Cobaugh et al. | 339/17 C |
| 4,274,700 | 6/1981 | Keglewitsch et al. | 339/192 R |
| 4,464,007 | 8/1984 | Parmer | 339/200 T |
| 4,471,339 | 9/1984 | Fukada et al. | 439/83 |
| 4,480,151 | 10/1984 | Dozier | 174/153 R |
| 4,494,172 | 1/1985 | Leary et al. | 361/400 |
| 4,565,416 | 1/1986 | Rudy et al. | 339/59 M |
| 4,583,807 | 4/1986 | Kaufman et al. | 339/125 R |
| 4,631,639 | 12/1986 | Biraud | 361/417 |
| 4,655,525 | 4/1987 | Hunt, III et al. | 339/63 M |
| 4,676,565 | 6/1987 | Reichardt | 439/79 |
| 4,762,507 | 8/1988 | Rudy, Jr. et al. | 439/595 |
| 4,826,453 | 3/1989 | Glomb et al. | 439/595 |
| 4,872,844 | 10/1989 | Grebe et al. | 439/69 |
| 4,913,673 | 4/1990 | Kobler | 439/736 |
| 4,941,847 | 7/1990 | Welsh | 439/595 |
| 4,944,688 | 7/1990 | Lundergan | 439/275 |
| 5,030,113 | 7/1991 | Wilson | 439/80 |
| 5,118,304 | 6/1992 | Fujitani et al. | 439/290 |
| 5,122,080 | 6/1992 | Hatagishi et al. | 439/595 |
| 5,158,470 | 10/1992 | Zarreii | 439/79 |
| 5,273,443 | 12/1993 | Frantz et al. | 439/595 |
| 5,352,125 | 10/1994 | Banakis et al. | 439/83 |
| 5,387,138 | 2/1995 | O'Malley | 439/751 |

FOREIGN PATENT DOCUMENTS

| | | |
|---|---|---|
| 1790043 | 12/1971 | Germany . |
| 2703942B1 | 10/1977 | Germany . |
| 3125089A1 | 1/1983 | Germany . |
| 972756 | 10/1964 | United Kingdom . |

OTHER PUBLICATIONS

AMP Technical Paper P205–78, "Complaint Pin—An Idea Whose Time Has Come", 178; AMP Incorporated, Harrisburg, PA.

AMP Technical Paper P241–81, "An analysis of Press–Fit Technology" May, 1981; AMP Incorporated, Harrisburg, PA.

*Primary Examiner*—Neil Abrams

*Attorney, Agent, or Firm*—Anton P. Ness

[57] ABSTRACT

An electrical connector (20) having a housing block (24) with a plurality of passageways (50) having tapered portions (56) and straight portions (58) into which are inserted respective contact terminals (34). The passageways and the contact terminals are so designed that the contact terminals are press-fit into the passageways and displace dielectric material of the housing block to provide a "seal" which prevents solder flux from wicking up the passageways. In addition, the contact terminals are formed with a longitudinal knurl (38) to prevent rotation of the contact terminals after insertion. Still further, each contact terminal is formed with a frusto-conical retention collar (42) having a rearward facing surface (66) which, upon exiting a passageway, abuts against a recessed stop ledge (64) formed in the housing block to prevent the subsequent removal of the contact terminal from the housing block. The housing block (24) also includes channels (60) that aid in removal of solder flux.

26 Claims, 6 Drawing Sheets

ELECTRICAL CONNECTOR HAVING PRESS-FIT CONTACTS FOR CIRCUIT BOARD MOUNTING

BACKGROUND OF THE INVENTION

This invention relates to electrical connectors and, more particularly, to improvements in the retention of contact terminals in connector housing blocks and in the solderability of connectors to printed circuit boards.

Electrical connectors must meet certain requirements and at the same time must be economical to manufacture. Therefore, it is desirable that a connector have a minimum number of parts and be susceptible to automated assembly. Some additional desirable attributes of an electrical connector are that the contact terminals are retained in the connector housing block after insertion, that the contact terminals not rotate after insertion, that fluxes used in a subsequent soldering operation are easily removable and that such solder fluxes are prevented from traveling to the mating area of the connector. It is therefore a general object of the present invention to provide an electrical connector satisfying all of the above requirements and having the above attributes.

In the past, a common way of retaining a contact terminal within a connector housing block was to utilize a retention spring (or clip) on the contact terminal. This adds an additional part for each contact terminal, as well as an additional step in the assembly of the connector. It is therefore another object of the present invention to provide an electrical connector wherein the contact terminal and the housing block have design features which cooperate to retain the connector terminal within the housing block without requiring additional parts.

SUMMARY OF THE INVENTION

The foregoing and additional objects are attained in accordance with the present invention by providing an electrical connector adapted to be mounted to a printed circuit board and having a housing block of dielectric material with a mounting face and an opposed mating face. The housing block is formed with at least one passageway extending therethrough from the mating face to the mounting face. The connector further includes at least one contact terminal associated with the at least one passageway. The contact terminal has a forward contact section adapted to be insertable into and through the passageway of the housing block from the mating face to the mounting face, a contact body section and a rearward mating section. The passageway through the housing block has a contact body receiving portion opening to the mating face and an exit portion opening to the mounting face, with the exit portion tapering inwardly toward the mounting face so as to be of reduced cross-sectional area relative to the contact body receiving portion. The housing block is cut away at least partially surrounding the exit portion of the passageway to form a resilient wall at least partially surrounding the exit portion. The housing block is further formed with a stop ledge recessed from the mounting face and adjacent to the exit portion, the stop ledge having at least a portion thereof on the resilient wall, and a portion of the stop ledge being defined by a portion of the housing block. The contact body section of the contact terminal is adapted to be press-fit into the passageway contact body receiving portion, with the rearward mating section of the contact terminal being accessible at the mating face of the housing block. The forward contact section of the contact terminal is formed with a retention collar of greater cross-sectional area than at least some of the passageway exit portion and the retention collar has a rearward facing surface adapted to abut the stop ledge when the contact terminal is fully inserted in the passageway. Thus, when the contact terminal is inserted into the passageway, as the retention collar passes through the exit portion the resilient wall is flexed outwardly from its unstressed position surrounding the exit portion and, as the retention collar leaves the exit portion, the resilient wall moves inwardly to return to its unstressed position so that the housing block stop ledge and the retention collar rearward facing surface abut in interfering relation to prevent rearward removal of the contact terminal from the passageway.

In accordance with an aspect of this invention, the passageway is circular in cross-section from the mating face to the stop ledge.

In accordance with another aspect of this invention, the contact terminal is circular in cross-section in its forward contact section and its contact body section. Further, the retention collar is of frusto-conical shape with an outward taper toward its rearward facing surface and the contact body section is formed with a longitudinal straight knurl which prevents rotation of the contact terminal after insertion.

In accordance with a further aspect of this invention, the contact body section of the contact terminal and the contact body receiving portion of the passageway are so dimensioned that when the contact body section is press-fit into the contact body receiving portion, the knurling on the contact body section displaces dielectric material of the housing block to fill spaces between the contact body section and the wall of the contact body receiving portion. Thus, when the forward contact section of the terminal is soldered to the printed circuit board, solder flux is prevented from wicking up the passageway beyond the contact body receiving portion.

In accordance with yet another aspect of this invention, the housing block is formed with a plurality of linearly arrayed parallel passageways and the cut away portion of the housing block forms a recessed channel substantially parallel to the line of passageways. Thus, the channel allows easy removal of flux after the contact terminals are soldered to the printed circuit board. Further, the channel preferably undulates to approximate a substantially uniform thickness for the wall surrounding each exit portion.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
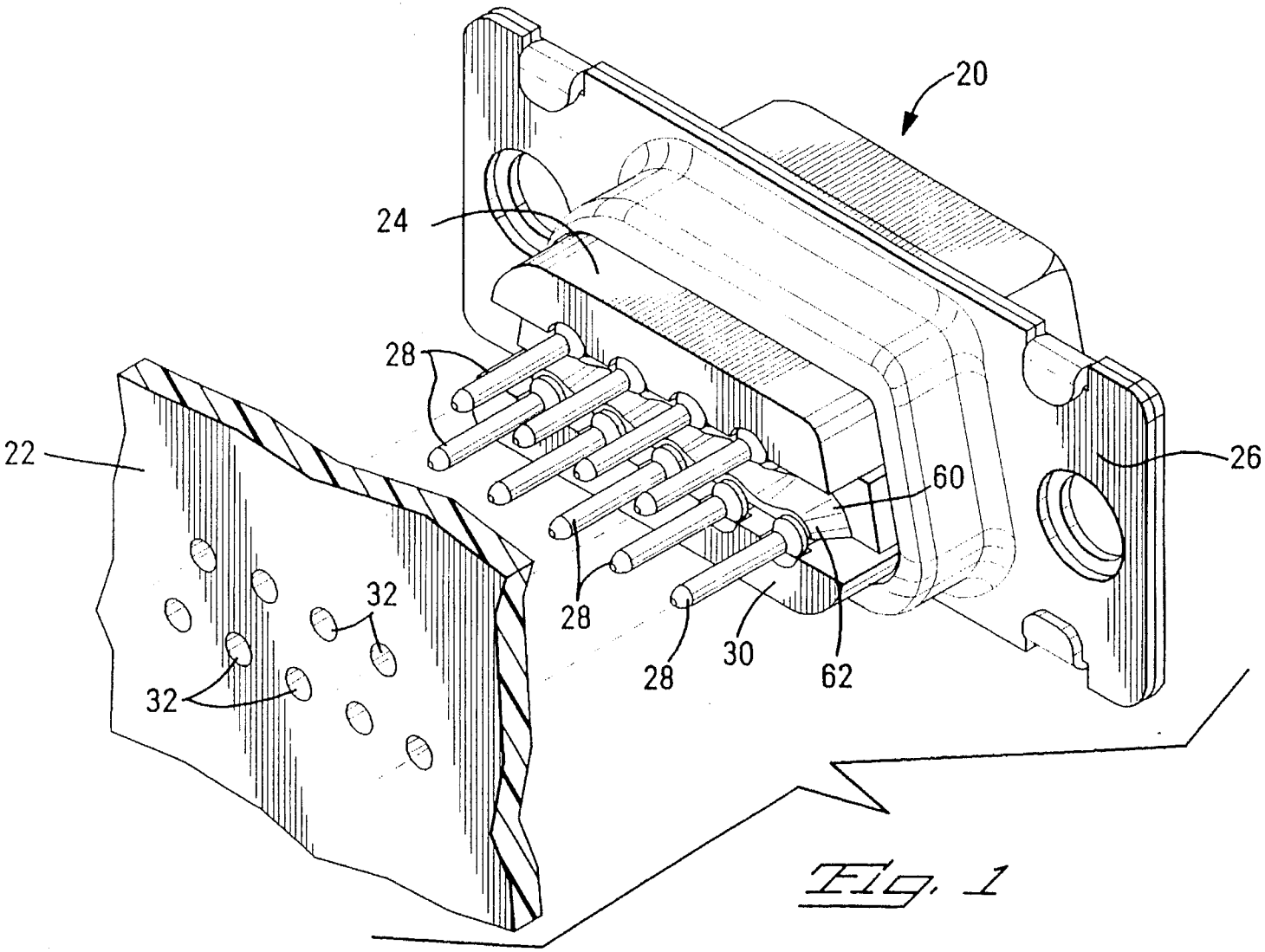
FIG. 1 is a perspective view, from the mounting face side, of an electrical connector constructed in accordance with the principles of this invention.

FIG. 1 illustrates an electrical connector, designated generally by the reference numeral 20 and constructed according to the principles of this invention, adapted to be mounted to the printed circuit board 22. The connector 20 includes a unitary housing block 24 at least partially surrounded by a metal shield 26, which shield is also used for securing a mating connector to the connector 20, as is well known and conventional in the art. The connector 20 also includes a plurality of contact terminals 28 which extend out of the mounting face 30 of the housing block 24 and are adapted to be inserted through appropriately positioned and sized openings 32 through the printed circuit board 22. The terminals 28 are thereafter soldered to the printed circuit board 22 for securing the connector 20 thereto.

Figures 2, 3:
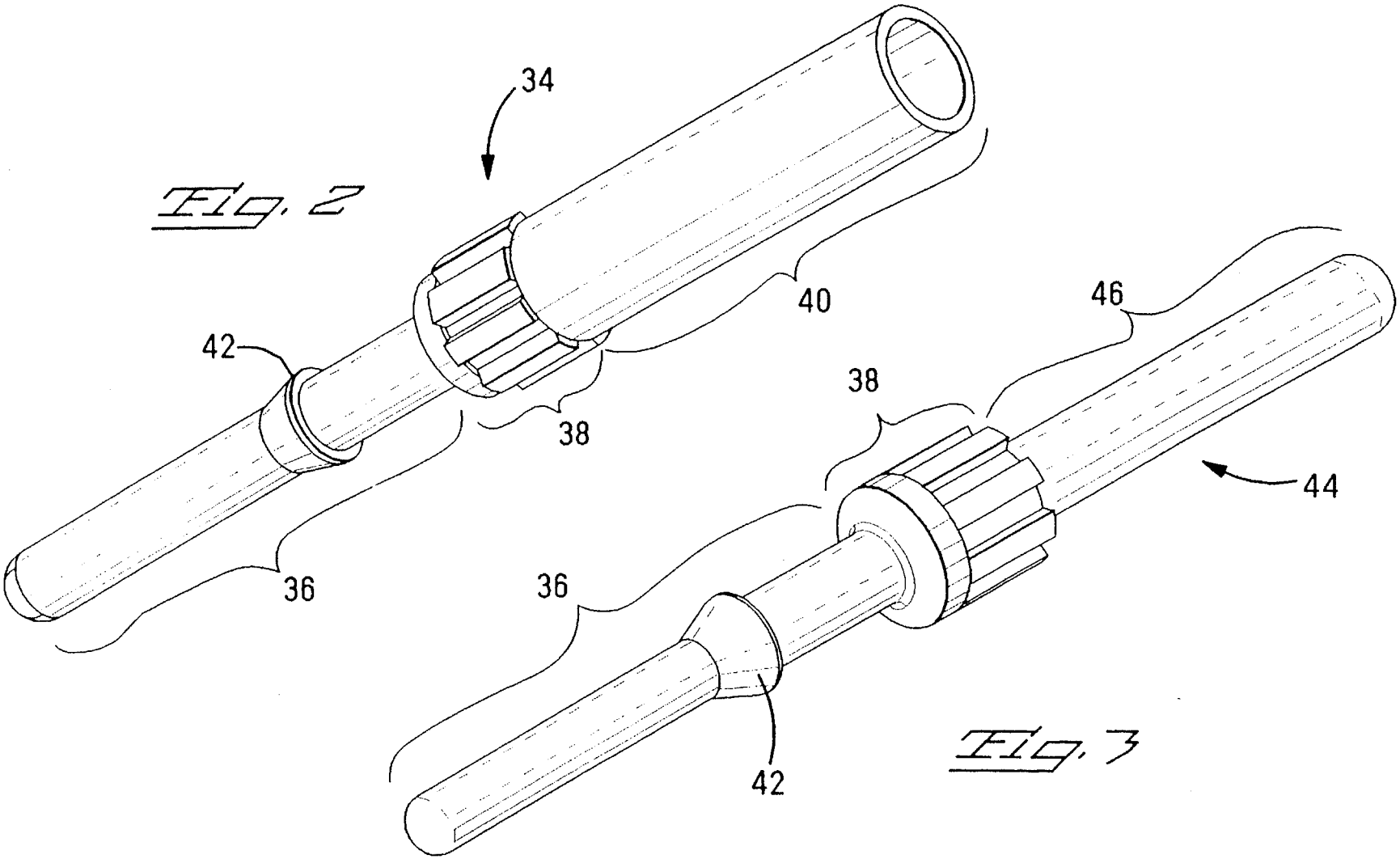
FIG. 2 is a perspective view of a contact terminal, with socket, constructed in accordance with the principles of this invention for use with the connector of FIG. 1.
FIG. 3 is a perspective view of a contact terminal, with pin, constructed in accordance with the principles of this invention for use with the connector of FIG. 1.

FIG. 2 illustrates a socket contact terminal 34 insertable into the housing block 24 in accordance with this invention. The contact terminal 34 includes a forward contact section 36, a contact body section 38 and a rearward mating section 40. As will be described in full detail hereinafter, the contact body section 38 is adapted to be press fit into a passageway of the housing block 24 and the forward contact section 36 is formed with a retention collar 42 which functions to interfere with removal of the contact terminal 34 after insertion into the housing block 24. FIG. 3 illustrates an alternate pin contact terminal 44 having an identical forward contact section 36 and contact body section 38, but a different rearward mating section 46 from the socket contact terminal 34. The difference between the contact terminals 34 and 44 will become clear upon reading the following description.

FIGS. 4–8 serve to illustrate the insertion of contact terminals into the connector housing block, as well as to illustrate the construction details of the terminals and the block.

Figure 4:
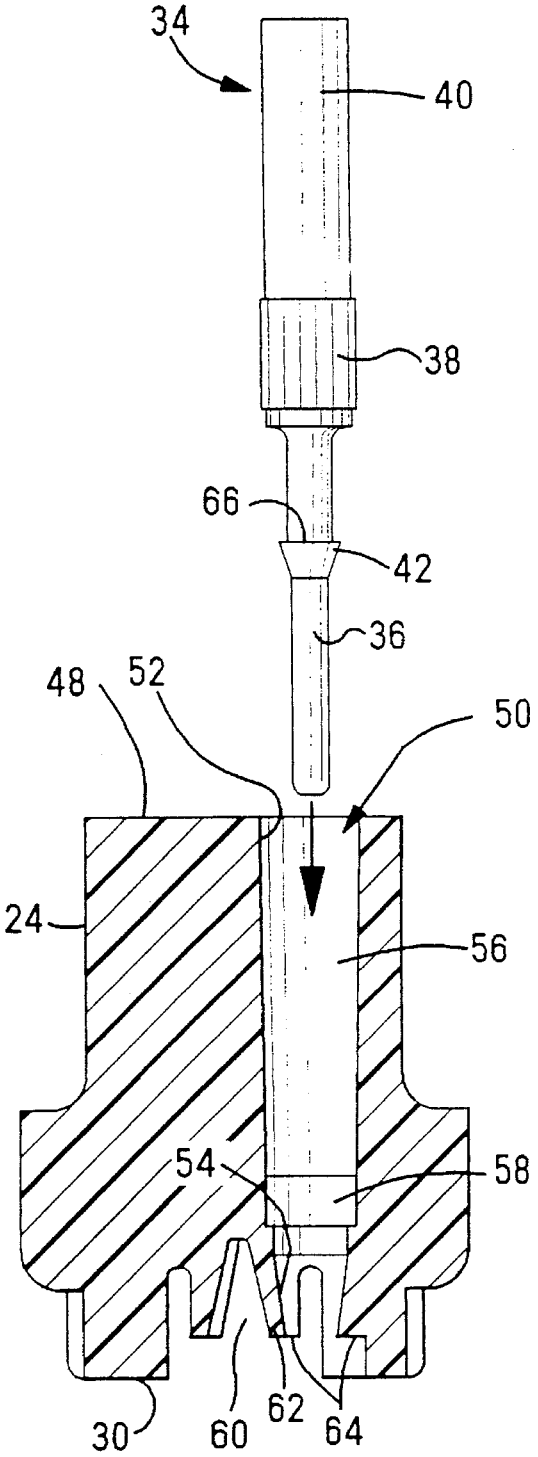
FIGS. 4 through 8 are cross sectional views of the inventive connector housing block, illustrating steps in the insertion of a socket contact terminal.

As shown in FIG. 4, the housing block 24 has a mounting face 30 and an opposed mating face 48. The mounting face 30 is adapted to be placed in parallel relationship to the surface of the printed circuit board 22 and the mating face 48 is adapted to be accessible to a complementary connector for mating therewith, as is well known and conventional in the art. According to the present invention, the housing block 24 is a unitary block of dielectric material and is formed with a plurality of passageways 50 which extend through the block 24 from the mating face 48 to the mounting face 30. Each passageway 50 is circular in cross section and has a contact body receiving portion 52 opening to the mating face 48 and an exit portion 54 opening to the mounting face 30. Preferably, the contact body receiving portion 52 has an outer first portion 56 which tapers inwardly from the mating face 48 and an inner second portion 58 of constant cross sectional area which is equal to the minimum cross sectional area of the outer first portion 56. The exit portion 54 tapers inwardly toward the mounting face 30 so as to be of reduced cross sectional area relative to the contact body receiving portion 52. The housing block 24 is cut away at 60 at least partially surrounding the exit portion 54 of the passageway 50 to form a resilient wall 62 at least partially surrounding the exit portion 54. The housing block 24 is further formed with a stop ledge 64 recessed from the mounting face 30 and adjacent the exit portion 54, with the stop ledge 64 having at least a portion thereof on the resilient wall 62.

As illustrated, the contact terminal 34 has a circular cross section for its forward contact section 36 and its rearward socket mating section 40. The contact body section 38 initially has a circular cross section of the same size as the rearward mating section 40, but is subjected to a processing step which provides a knurled finish of slightly increased maximum diameter. The diameter of the forward contact section 36, apart from the retention collar 42, is sufficiently small in cross sectional dimension that it readily passes through the passageway 50 without any interference therewith. However, the retention collar 42 tapers outwardly so as to be of frusto-conical shape and has a rearward facing surface 66. The outside diameter of the rearward facing surface 66 is greater than the inside diameter of the stop ledge 64. Thus, when the contact terminal 34 is fully inserted into the passageway 50, the tapered retention collar 42 engages the tapered portion of the exit portion 54 to cause the resilient wall 62 to be flexed outwardly from its unstressed position, and as the rearward facing surface 66 passes the stop ledge 64, the resilient wall 62 snaps back inwardly to its unstressed position, as shown in FIGS. 7 and 8.

As previously described, the contact body section 38 of the contact terminal 34 is knurled. Preferably, the contact body section 38 is formed with a longitudinal straight knurl, as best seen in FIGS. 2 and 3. This knurling provides two important functions. First, as a contact body section 38 is press fit into the inner second portion 58 of the contact body receiving portion 52, the knurling thereon displaces dielectric material of the housing block 24 which fills the spaces between the contact body section 38 and the wall of the inner second portion 58. Then, when the forward contact section 36 of the contact terminal 34 is soldered to the printed circuit board 22, solder flux is prevented from wicking up the passageway 50 beyond the inner second portion 58 into the contact mating area. The second function of the longitudinal straight knurling is to prevent rotation of the contact terminal 34 after insertion into the passageway 50. Although as shown in FIG. 1, the connector 20 has straight contact terminals, there are applications where the contact terminals are bent at right angles before attachment to a printed circuit board. Under such circumstances, it would be disadvantageous to allow the contact terminals to rotate after they are bent.

Figure 5:
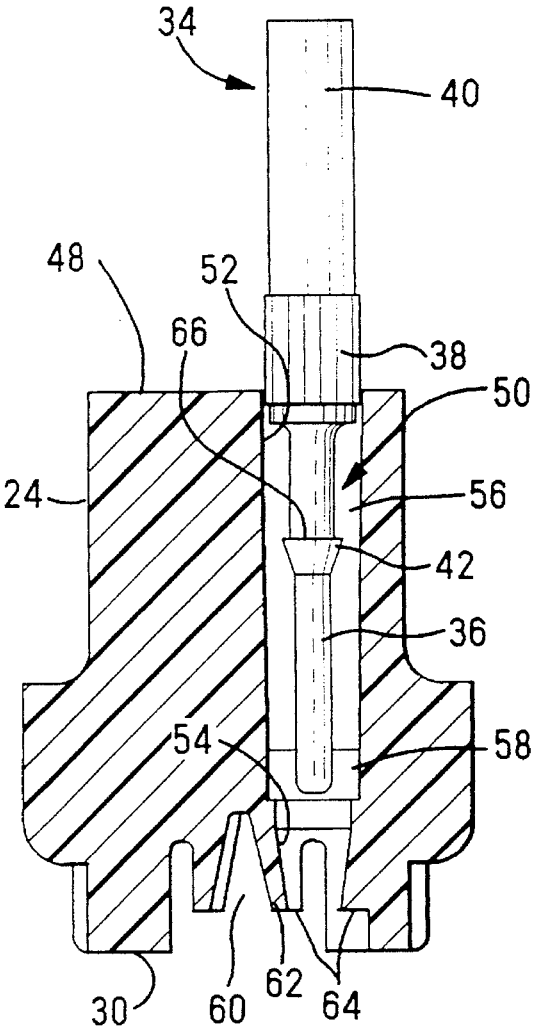
Figure 6:
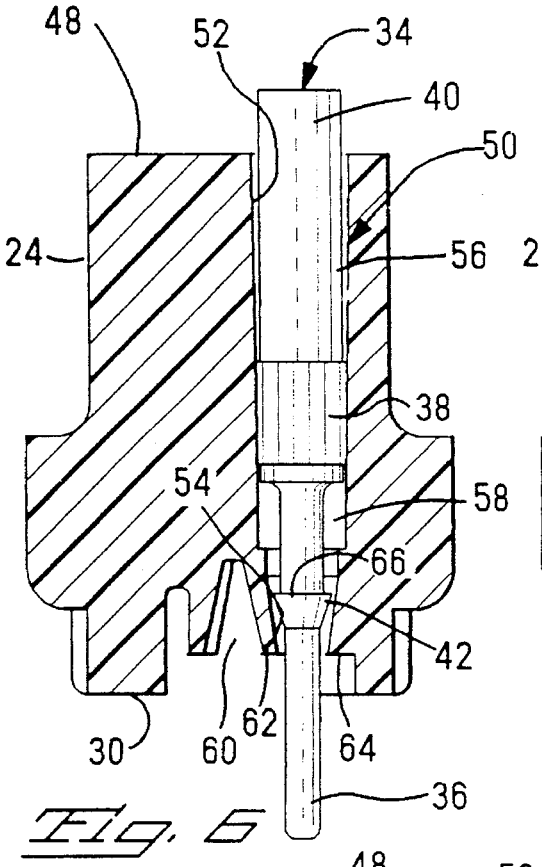
Figure 7:
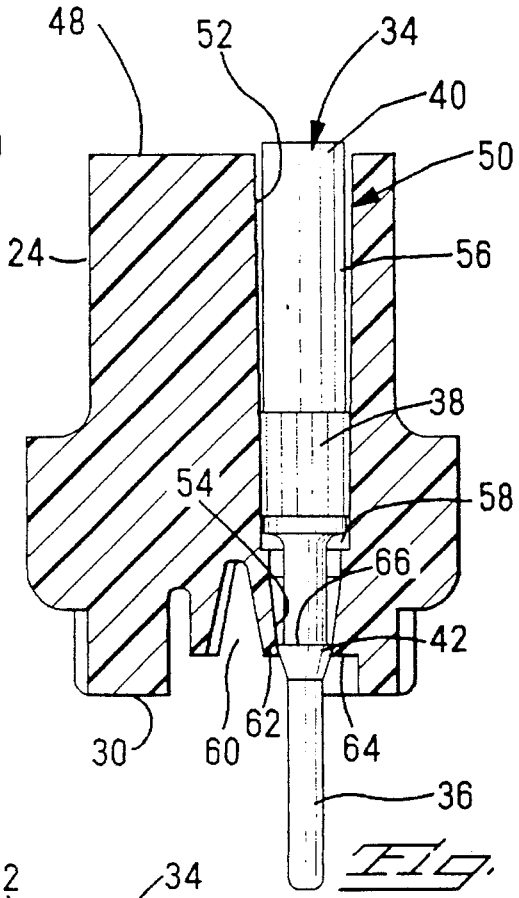
Figure 8:
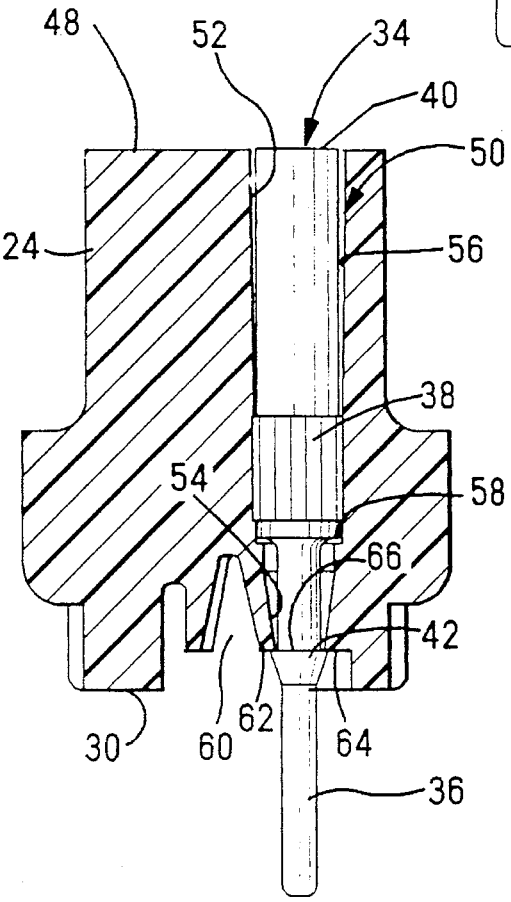

FIGS. 4–8 illustrate steps in the insertion of a contact terminal 34 into a passageway 50. Such insertion can be automated, does not require a bonding operation, and results in retention of the contact terminal 34 within the passageway 50 without requiring a separate retention clip. Thus, as shown in FIG. 4, the contact terminal 34 is first aligned with the passageway 50. As shown in FIG. 5, the forward contact section 36 is inserted into the passageway 50, with the knurled contact body section 38 just entering the outer first portion 56 of the contact body receiving portion 52. This outer first portion 56 has a diameter which is preferably slightly greater than the maximum diameter of the knurled contact body section 38. As shown in FIG. 6, the contact body section 38 is almost fully inserted into the outer first portion 56. As shown in FIG. 7, the contact body section 38 is partially inserted into the inner second portion 58. Preferably, the diameter of the inner second portion 58 is the same as the diameter of the outer first portion 56 where they meet (i.e., the minimum diameter of the tapered outer first portion 56), which is slightly less than the nominal diameter of the knurled body section 38. As shown in FIG. 7, the retention collar 42 causes the wall 62 to flex outwardly. Finally, as shown in FIG. 8, the contact terminal 34 is fully inserted in the passageway 50 so that the rearward facing surface 66 of the retention collar 42 has passed the stop ledge 64. The wall 62 has therefore snapped back to its unstressed position and the abutment of the rearward facing surface 66 with the stop ledge 64 interferes with the subsequent removal of the contact terminal 34 from the passageway 50, without requiring an additional retention clip.

Figure 9:
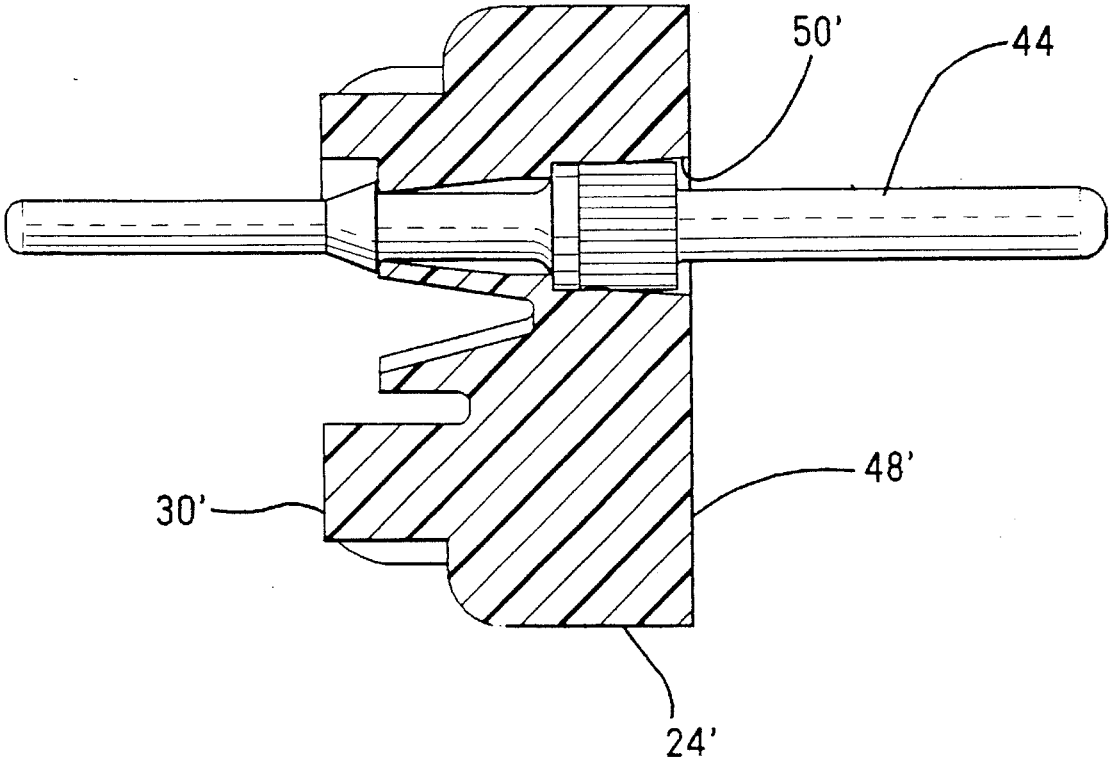
FIG. 9 is a cross sectional view of a modified connector housing block for use with a pin contact terminal.

FIG. 9 illustrates a modified housing block 24' adapted to accept the pin contact terminal 44 (FIG. 3) which has a mating pin in substitution for the mating socket (barrel) of the contact terminal 34. In this case, the housing block 24' is truncated so that within the passageway 50' there is no outer first portion 56 of the contact body receiving portion 52. In all other respects, the housing block 24' is the same as the housing block 24.

As previously described, the housing block 24 is cut away at 60 to form the resilient wall 62. In a practical application, the connector 20 has a plurality of linearly arrayed parallel passageways 50. The cut away portion 60 of the housing block 24 thus forms a recessed channel substantially parallel to the line of passageways 50. This channel provides a function in addition to forming the resilient wall 62. That function is to provide a means by which flux utilized during the process of soldering the contact terminals to the printed circuit board is easily removed. Preferably, the channel 60 undulates to approximate a substantially uniform thickness for the wall 62 surrounding each exit portion 54. It can be seen that the housing block is formed from material that is nonresilient and relatively noncompressible, to have a resilient wall that is deflectable to cooperate with the annular collar of the contact during insertion. The connector 20 was specifically designed to meet military specifications and the dielectric material forming the housing block 24 is relatively brittle. Illustratively, the dielectric material may be Vectra™ A130 thermoplastic liquid crystal polymer (LCP) manufactured by Hoechst-Celanese, which is approved for military applications, has a zero shrink rate and withstands soldering temperatures. Alternatively, Vectra™ E130 (another LCP) may be utilized. It is desirable to utilize a material which reduces knit lines.

Figure 10:
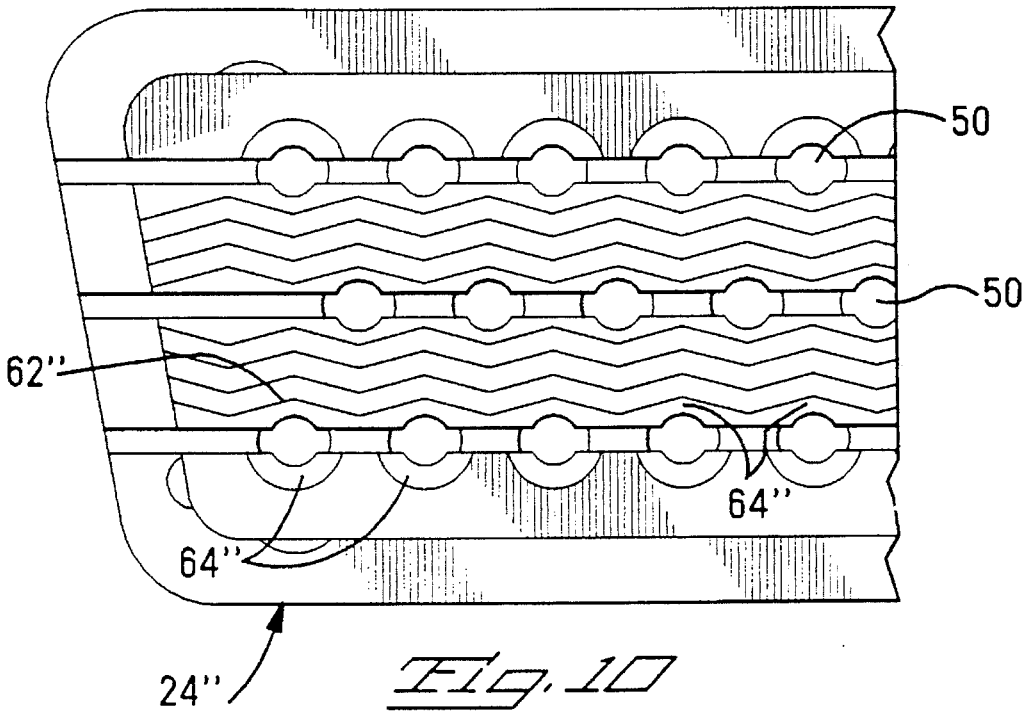
FIG. 10 is an enlarged plan view showing the mounting face of a connector housing block according to another embodiment of this invention.

Substantially uniform thickness for the wall 62 is desirable to reduce stress in the wall during insertion of the contact terminals, when the wall is flexed. It is preferred that the undulations defining the wall 62 be of arcuate, or wavy, form, as shown in FIG. 1. However, for reasons of economy when making the housing mold, the channel undulation can take on a zigzag form, as shown in FIG. 10. Further as shown in FIG. 10, the housing block 24" is formed with a plurality of parallel rows of evenly spaced passageways, with the passageways within each row being offset from the passageways of each adjacent row, so that a recessed channel between adjacent rows of passageways approximates a substantially uniform thickness for the wall surrounding each exit portion. It has been found that using a zigzag undulation for the channel results in a more economical mold than a channel of wavy form, with the stress level still being within an acceptable range.

Figure 11:
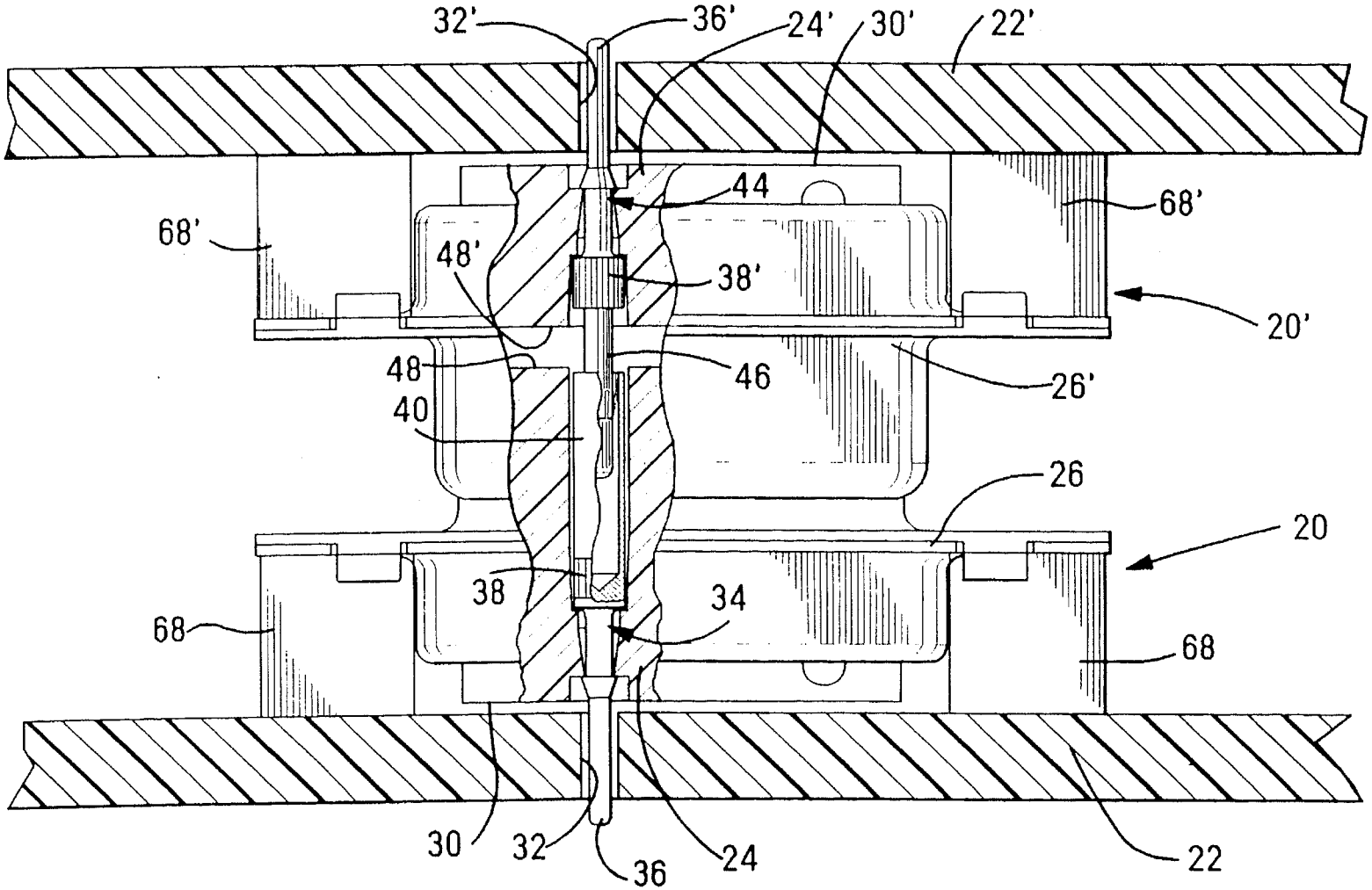
FIG. 11 is a partially sectioned side view showing a pair of complementary mated connectors according to this invention mounted to respective printed circuit boards.

FIG. 11 illustrates complementary mated connectors 20, 20' each mounted to a respective printed circuit board 22, 22', and showing the mating of the contact terminals 34, 44. As shown, the connector 20 is mounted to the printed circuit board 22 by means of stand-off blocks 68 interposed between the printed circuit board 22 and the shield 26 so as to maintain the mounting face 30 of the housing block 24 in parallel relationship to the surface of the board 22. Similarly, the connector 20' is mounted to the printed circuit board 22' by the stand-off blocks 68'. Although FIG. 11 illustrates the mating of two connectors each mounted to a respective printed circuit board, it is understood that the present invention also has utility where one of the connectors is mounted to a printed circuit board and the complementary mating connector terminates a multi-wire cable.

Accordingly, there has been disclosed an electrical connector which is improved with regard to the retention of contact terminals in the connector housing block and in the solderability of the connector to a printed circuit board. It is understood that the above-described embodiments are merely illustrative of the application of the principles of this invention. Numerous other embodiments may be devised by those skilled in the art without departing from the spirit and scope of this invention, as defined by the appended claims. For example, a connector utilizing the knurled contact portion of the present invention force-fit into a connector housing passageway can be used for right angle mounting to a circuit board, where the pin contact sections extending forwardly of the mounting face are bent at right angles prior to insertion into plated through-holes of the board; the knurling that digs into the sidewalls of the passageway, advantageously prevents rotation during the bending step and the subsequent board mounting.

What is claimed is:

1. An electrical connector adapted to be mounted to a circuit board and comprising:

a housing block of relatively noncompressible dielectric material having a board-mounting face and an opposed mating face, said housing block being formed with a plurality of passageways in at least one row extending therethrough from said mating face to said board-mounting face, each of said passageways having a contact body receiving portion opening to said mating face and an exit portion opening to said board-mounting face, said exit portion tapering inwardly toward said board-mounting face so as to be of reduced cross-sectional area relative to said contact body receiving portion;

said housing block including a nonresilient portion partially surrounding said exit portions of said passageways of each said row, and said housing block being cut away at least partially surrounding said exit portions of said passageways to form a resilient wall partially surrounding said exit portions of said passageways of each said row thereof and also forming a recessed channel adjacent said resilient wall, said housing block further including a stop ledge recessed from said mounting face and adjacent to each said exit portion, said stop ledge having a portion thereof defined on said resilient wall and a portion defined on said nonresilient housing block portion; and a contact terminal associated with each said passageway, said contact terminal having a forward contact section adapted to be insertable into and through said passageway from said mating face to said board-mounting face, a contact body section and a rearward mating section, said contact body section adapted to be press-fit into said passageway contact body receiving portion with said rearward mating section being accessible at said mating face, said forward contact section being formed with a retention collar of greater cross-sectional area than at least some of said passageway exit portion, said retention collar having a rearward facing surface adapted to abut said stop ledge when said at least one contact terminal is fully inserted in said one passageway;

whereby, upon insertion of said contact terminal into said passageway, as said retention collar passes through said exit portion the resilient wall is flexed outwardly from its unstressed position surrounding said exit portion and as said retention collar leaves said exit portion the resilient wall moves inwardly to return to its unstressed position so that the housing block stop ledge and the retention collar rearward facing surface abut in interfering relation to prevent rearward removal of the contact terminal from the passageway.

2. The connector according to claim 1 wherein said at least one passageway is circular in cross-section from said mating face to said stop ledge.

3. The connector according to claim 2 wherein said at least one contact terminal is circular in cross-section in its forward contact section and its contact body section.

4. The connector according to claim 3 wherein said retention collar is of frusto-conical shape with an outward taper toward its rearward facing surface.

5. The connector according to claim 3 wherein said contact body section is formed with a longitudinal straight knurl.

6. The connector according to claim 5 wherein said contact body section and said passageway contact body receiving portion are so dimensioned that when said contact body section is press-fit into said passageway contact body receiving portion the knurling on said contact body section displaces dielectric material of said housing block to fill spaces between said contact body section and the wall of said passageway contact body receiving portion;

whereby, when said forward contact section is soldered to said printed circuit board, solder flux is prevented from wicking up the passageway beyond the contact body receiving portion.

7. The connector according to claim 6 wherein said passageway contact body receiving portion has an outer first portion which tapers inwardly from said mating face and an inner second portion of constant cross sectional area equal to the minimum cross sectional area of said outer first portion.

8. The connector according to claim 7 wherein the diameter of said inner second portion of said passageway contact body receiving portion is slightly less than the nominal diameter of the knurl of said contact body section.

9. The connector according to claim 1 wherein said channel undulates to approximate a substantially uniform thickness for the wall surrounding each exit portion.

10. The connector according to claim 9 wherein said housing block is formed with a plurality of parallel rows of evenly spaced passageways, with the passageways within each row being offset from the passageways of each adjacent row, so that a channel between adjacent rows approximates a substantially uniform thickness for the wall surrounding each exit portion.

11. The connector according to claim 9 wherein the channel undulation is of zigzag form.

12. The connector according to claim 9 wherein the channel undulation is of arcuate form.

13. The connector according to claim 1 wherein said stop ledge is defined at a forwardmost end of a respective said passageway by a leading edge of said resilient wall.

14. An electrical connector adapted to be mounted to a circuit board and comprising:

a housing block of relatively noncompressible dielectric material having a board-mounting face and an opposed mating face, said housing block being formed with at least one passageway extending therethrough from said mating face to said board-mounting face, said passageway having a contact body receiving portion opening to said mating face and an exit portion opening to said board-mounting face; and at least one contact terminal associated with said at least one passageway, said at least one contact terminal having a forward contact section, a contact body section and a rearward mating section, said forward contact section adapted to be insertable into and through said passageway from said mating face to said board-mounting face, said contact body section being formed with a longitudinal straight knurl and adapted to be press-fit into said passageway contact body receiving portion with said rearward mating section being accessible at said mating face; and said contact body section and said passageway contact body receiving portion are so dimensioned that when said contact body section is press-fit into said passageway contact body receiving portion the knurling on said contact body section displaces dielectric material of said housing block to fill spaces between said contact body section and the wall of said passageway contact body receiving portion, whereby, when said forward contact section is soldered to said circuit board, solder flux is prevented from wicking up the passageway beyond the contact body receiving portion.

15. The connector according to claim 14 wherein said forward contact section of each said contact terminal is retained in a straight configuration after insertion through its respective said passageway.

16. The connector according to claim 14 wherein said passageway contact body receiving portion has an outer first portion which tapers inwardly from said mating face and an inner second portion of constant cross sectional area equal to the minimum cross sectional area of said outer first portion.

17. The connector according to claim 16 wherein the diameter of said inner second portion of said passageway contact body receiving portion is slightly less than the nominal diameter of the knurl of said contact body section.

18. The connector according to claim 14 wherein:

said passageway exit portion tapers inwardly toward said board-mounting face so as to be of reduced cross-sectional area relative to said contact body receiving portion, said housing block is cut away at least partially surrounding said exit portion to form a resilient wall at least partially surrounding said exit portion, said housing block is further formed with a stop ledge recessed from said board-mounting face and adjacent to said exit portion, and said stop ledge has at least a portion thereof on said resilient wall; and said contact terminal forward contact section is formed with a retention collar of greater cross-sectional area than at least some of said passageway exit portion, and said retention collar has a rearward facing surface adapted to abut said stop ledge when said at least one contact terminal is fully inserted in said at least one passageway;

whereby, upon insertion of said at least one contact terminal into said at least one passageway, as said retention collar passes through said exit portion the resilient wall is flexed outwardly from its unstressed position surrounding said exit portion and as said retention collar leaves said exit portion the resilient wall moves inwardly to return to its unstressed position so that the housing block stop ledge and the retention collar rearward facing surface abut in interfering relation to prevent rearward removal of the at least one contact terminal from the at least one passageway.

19. The connector according to claim 18 wherein said at least one passageway is circular in cross-section from said mating face to said stop ledge.

20. The connector according to claim 19 wherein said at least one contact terminal is circular in cross-section in its forward contact section and its contact body section.

21. The connector according to claim 20 wherein said retention collar is of frusto-conical shape with an outward taper toward its rearward facing surface.

22. The connector according to claim 18 wherein said housing block is formed with a plurality of linearly arrayed parallel passageways and the cut away portion of said housing block forms a recessed channel substantially parallel to the line of passageways.

23. The connector according to claim 22 wherein said channel undulates to approximate a substantially uniform thickness for the wall surrounding each exit portion.

24. The connector according to claim 23 wherein said housing block is formed with a plurality of parallel rows of evenly spaced passageways, with the passageways within each row being offset from the passageways of each adjacent row, so that a channel between adjacent rows approximates a substantially uniform thickness for the wall surrounding each exit portion.

25. The connector according to claim 23 wherein the channel undulation is of zigzag form.

26. The connector according to claim 23 wherein the channel undulation is of arcuate form.

* * * * *